US008992180B2

(12) United States Patent
Agaram et al.

(10) Patent No.: US 8,992,180 B2
(45) Date of Patent: Mar. 31, 2015

(54) REPLACEABLE STAKING INSERT ASSEMBLY AND METHOD

(75) Inventors: Sukumar Agaram, Bangalore (IN); Narasimha K V Rao, Bangalore (IN)

(73) Assignee: General Electric Company, Schenectady, NY (US)

( * ) Notice: Subject to any disclaimer, the term of this patent is extended or adjusted under 35 U.S.C. 154(b) by 889 days.

(21) Appl. No.: 13/217,156

(22) Filed: Aug. 24, 2011

(65) Prior Publication Data

US 2013/0052025 A1 Feb. 28, 2013

(51) Int. Cl.
*F01D 5/32* (2006.01)
*F01D 5/30* (2006.01)

(52) U.S. Cl.
CPC ..... *F01D 5/30* (2013.01); *F01D 5/3007* (2013.01); *F01D 5/323* (2013.01); *F01D 5/326* (2013.01)
USPC ..... 416/221

(58) Field of Classification Search
CPC ..... F01D 5/323; F01D 5/326; F01D 5/32; F03D 11/00
USPC ..... 416/215, 218, 219 R, 220 R, 221, 204 R
See application file for complete search history.

(56) References Cited

U.S. PATENT DOCUMENTS 4,711,007 A * 12/1987 Conrad ..... 29/889.21
5,860,787 A * 1/1999 Richards ..... 416/220 R
2006/0018756 A1* 1/2006 Schroder ..... 416/219 R
2009/0077795 A1 3/2009 Prince et al.
2009/0252611 A1 10/2009 Tipton et al.

FOREIGN PATENT DOCUMENTS

DE 102009003712 A1 10/2009
EP 0712995 A1 5/1996
GB 2313162 A 11/1997

OTHER PUBLICATIONS

Search Report and Written Opinion from EP Application No. 12180323.3 dated Nov. 21, 2012.

* cited by examiner

*Primary Examiner* — Nathaniel Wiehe
*Assistant Examiner* — Jeffrey A Brownson
(74) *Attorney, Agent, or Firm* — Sutherland Asbill & Brennan LLP

(57) ABSTRACT

A rotor assembly. The rotor assembly may include a rotor, at least one axial slot positioned about the rim of the rotor having a first staking recess positioned therein, a blade positioned within each of the axial slots having a second staking recess positioned therein, a staking insert having a base portion and a projection extending therefrom with the base portion being disposed within the first staking recess and the projection being disposed within the second staking recess, and a shim positioned within the first staking recess adjacent to the base portion, opposite the projection, of the staking insert. The first staking recess retains the staking insert while the projection of the staking insert retains the blade in both the aft and forward directions.

20 Claims, 6 Drawing Sheets

REPLACEABLE STAKING INSERT ASSEMBLY AND METHOD

TECHNICAL FIELD

The present application relates generally to a replaceable staking insert assembly for the retention of a wheel attachment, and more particularly relates to a replaceable staking insert assembly for a blade mounted on a compressor rotor.

BACKGROUND OF THE INVENTION

Gas turbine systems generally include a compressor rotor having a number of stages. Air flowing into the compressor is compressed at each stage. Each stage includes a number of rotor buckets or blades mounted to a rim of a rotor wheel or a disk in a spaced relationship. A typical compressor rotor may have dozens of rotor blades mounted thereon.

Generally described, each blade may have a dovetailed portion that interlocks with a dovetail region of the rim to secure the blade to the rotor. The blade dovetails may be secured to the rotor via a process called "staking" Specifically, the rotor blade is placed within the rim slot and then "staked" into place at both ends by deforming the metal material around the blade dovetail with a tool similar to a nail punch. This process is then repeated for each rotor blade for each rotor assembly stage. Staking provides an economical and mechanically secured means of securing a blade or other attachment to the rotor or other type of wheel slot.

In an inspection or an overhaul process, the rotor blades may be removed from the rotor wheel and the original "stakes" may be ground out. There are a finite number of attachments due to a limited number of viable staking locations about the rotor wheel. As such, the rotor wheel generally must be replaced once these staking locations have been consumed even if the rotor wheel is otherwise still in operation.

There is a desire, therefore, for improved methods and devices for securing a blade or other type of wheel attachment to a rotor or other type of wheel without destroying the rotor or wheel or limiting its part life. These improved methods and devices should provide for simple but secure attachment of the blade or other component to the wheel in a fast and efficient manner.

BRIEF DESCRIPTION OF THE INVENTION

The present application describes a rotor assembly. Embodiments of the rotor assembly may include a rotor, at least one axial slot positioned about a rim of the rotor having a first staking recess positioned therein, a blade positioned within each axial slot having a second staking recess positioned therein, a staking insert having a base portion and a projection extending therefrom with the base portion being disposed within the first staking recess and the projection being disposed within the second staking recess, and a shim positioned within the first staking recess and adjacent to the base portion, opposite the projection, of the staking insert.

The application further describes a gas turbine having a rotor assembly disposed therein. Embodiments of the rotor assembly may include a rotor, at least one axial slot positioned about a rim of the rotor having a first staking recess positioned therein, a blade positioned within each axial slot having a second staking recess positioned therein, a staking insert having a base portion and a projection extending therefrom with the base portion being disposed within the first staking recess and the projection being disposed within the second staking recess, and a shim positioned within the first staking recess and adjacent to the base portion, opposite the projection, of the staking insert.

The application still further describes a method for staking a blade in a rotor assembly. Embodiments of the method may include providing a rotor having at least one axial slot positioned about a rim of the rotor having a first staking recess positioned therein, providing a blade having a second staking recess positioned therein, inserting a staking insert having a base portion and a projection therefrom into the first staking recess, thereafter positioning the blade within the axial slot of the rotor, inserting a shim into the first staking recess such that the projection of the staking insert is positioned within the second staking recess of the blade and the shim is adjacent to the base portion, opposite the projection, of the staking insert, and deforming the staking insert such that the shim is retained within the first staking recess.

DETAILED DESCRIPTION OF THE INVENTION

The present application will now be described more fully hereinafter with reference to the accompanying drawings, in which several embodiments of the application are shown. Like numbers refer to like elements throughout the drawings.

Figure 1A:
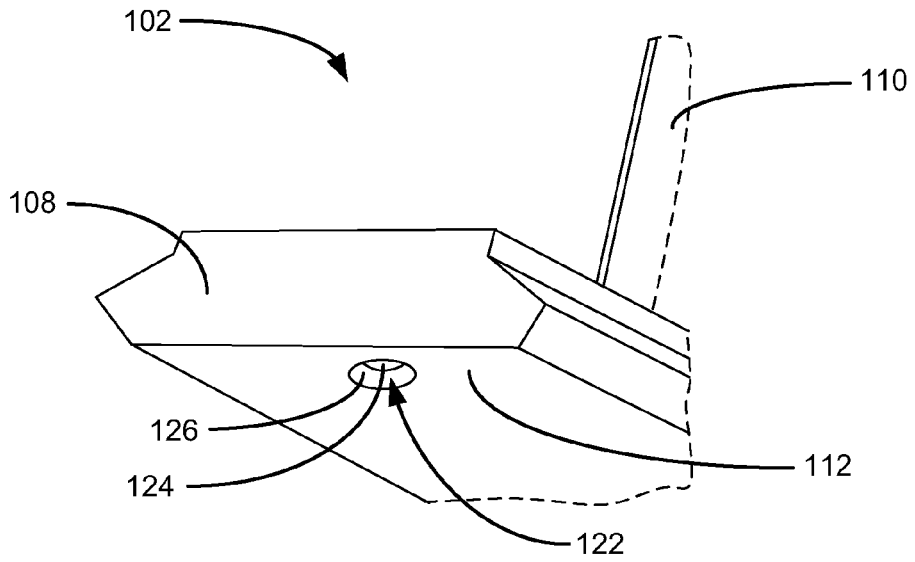
FIG. 1A is a perspective view of a rotor blade according to an embodiment of the invention.
Figure 1B:
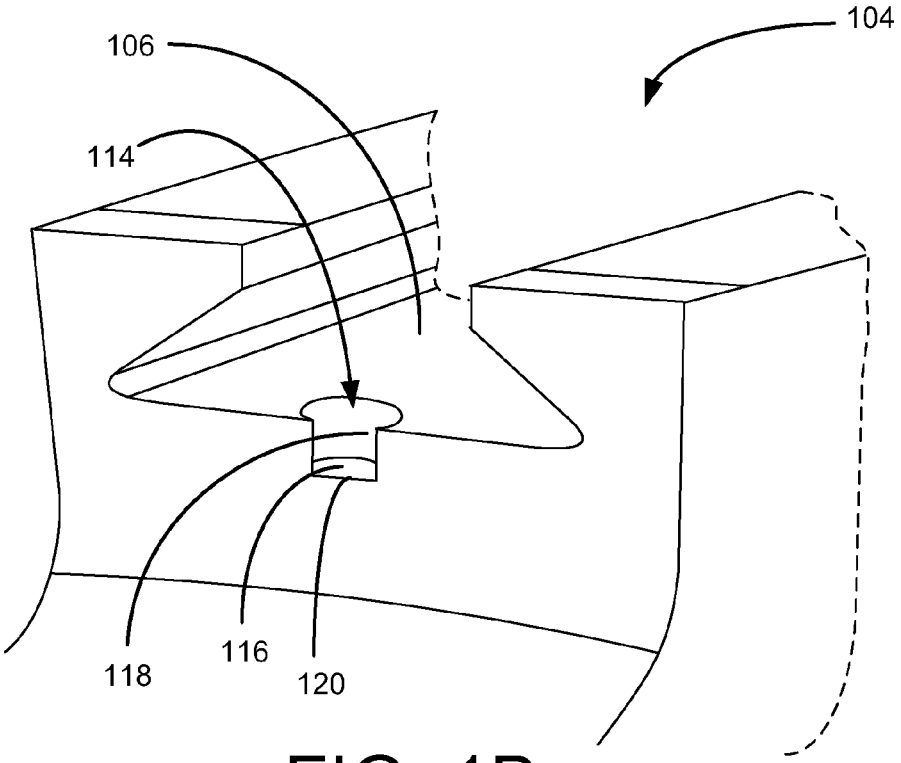
FIG. 1B is a perspective view of an embodiment of a rotor for receiving the rotor blade of FIG. 1A.

In one aspect, a rotor assembly is provided. FIGS. 1A and 1B show a rotor blade 102 and a rotor 104, respectively, which are components of a rotor assembly. The rotor 104 may include at least one axial slot 106 positioned about the rim of the rotor 104. The axial slot 106 may be any shape known in the art. In certain embodiments, the axial slot 106 has a dovetail-like shape. The axial slot 106 may include a first staking recess 114 positioned therein. In some embodiments, the first staking recess includes a base and at least one sidewall. In one embodiment, the first staking recess 114 is positioned at one end of the axial slot 106 and has a base 116 and a concave sidewall 118 that defines an axial opening 120. However, other shapes of the first staking recess also are envisioned. For example, the first staking recess may have a trapezoidal, circular, triangular, T-shaped, or rectangular cross-section, or a combination thereof. The first staking recess may be conical or tapered. Those skilled in the art should appreciate that the shape and dimensions of the first staking recess may vary with the geometry of the axial slot and the rotor assembly as a whole.

In some embodiments, the blade 102 includes a root 108 with an airfoil 110 extending therefrom. The root 108 may have a substantial dovetail-like shape that conforms to the dovetail-like shape of the axial slot 106. Additionally, the rotor blade 102 may include a second staking recess 122 positioned therein. In certain embodiments, the second staking recess 122 is positioned on the base 112 of the root 108 of the blade 102. In some embodiments, the second staking recess includes a base and at least one sidewall. In one embodiment, the second staking recess 122 is positioned near one end of the root 108 and has a base 124 and a cylindrical sidewall 126. However, other shapes of the second staking recess also are envisioned. For example, the second staking recess may have a trapezoidal, circular, truncated triangular, T-shaped, or rectangular cross-section, or a combination thereof. The second staking recess may be conical or tapered. Those skilled in the art will appreciate, however, that the shape and dimensions of the second staking recess may vary with the geometry of the blade and the rotor assembly as a whole.

Figure 1C:
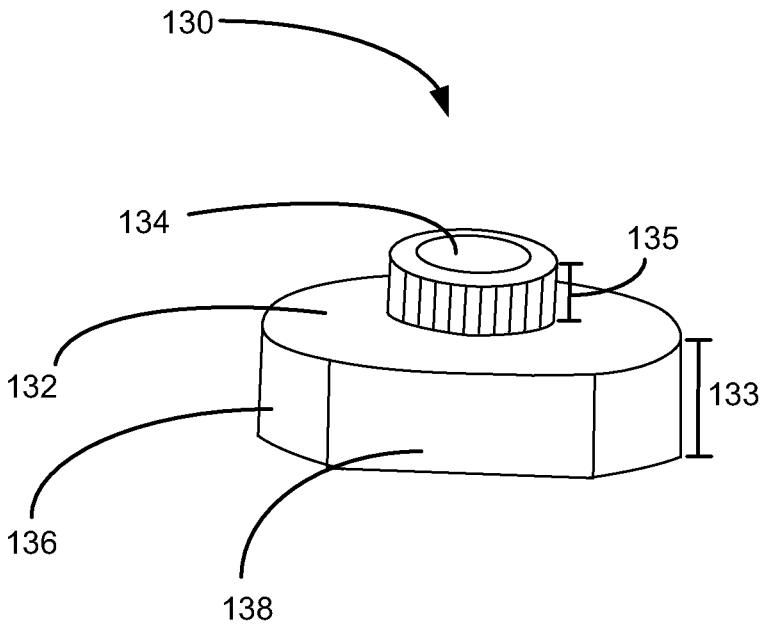
FIG. 1C is a perspective view of an embodiment of a staking insert.

FIG. 1C shows a staking insert 130. The staking insert 130 may include a base portion 132 and a projection 134 extending therefrom. In certain embodiments, the base portion 132 of the staking insert 130 has a convex sidewall 136 extending from a flat sidewall 138. Other shapes of the base portion are also envisioned. For example, the base portion may be cylindrical, cubic, conical, T-shaped, or a combination thereof. The base portion may also be tapered. In certain embodiments, the projection 134 is cylindrical in shape. Other shapes of the projection are also envisioned. For example, the projection may be conical, cubic, T-shaped, rectangular, tapered, or a combination thereof.

Figure 2:
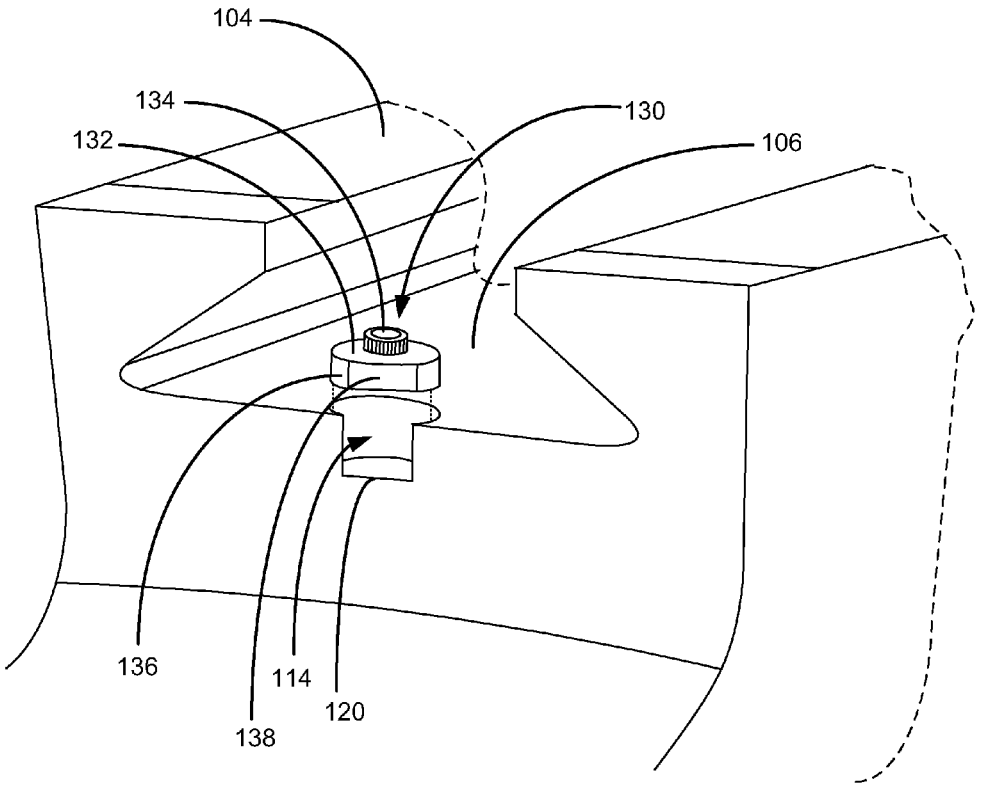
FIG. 2 is a perspective view of a staking insert being positioned within the rotor illustrated in FIG. 1B.
Figure 3:
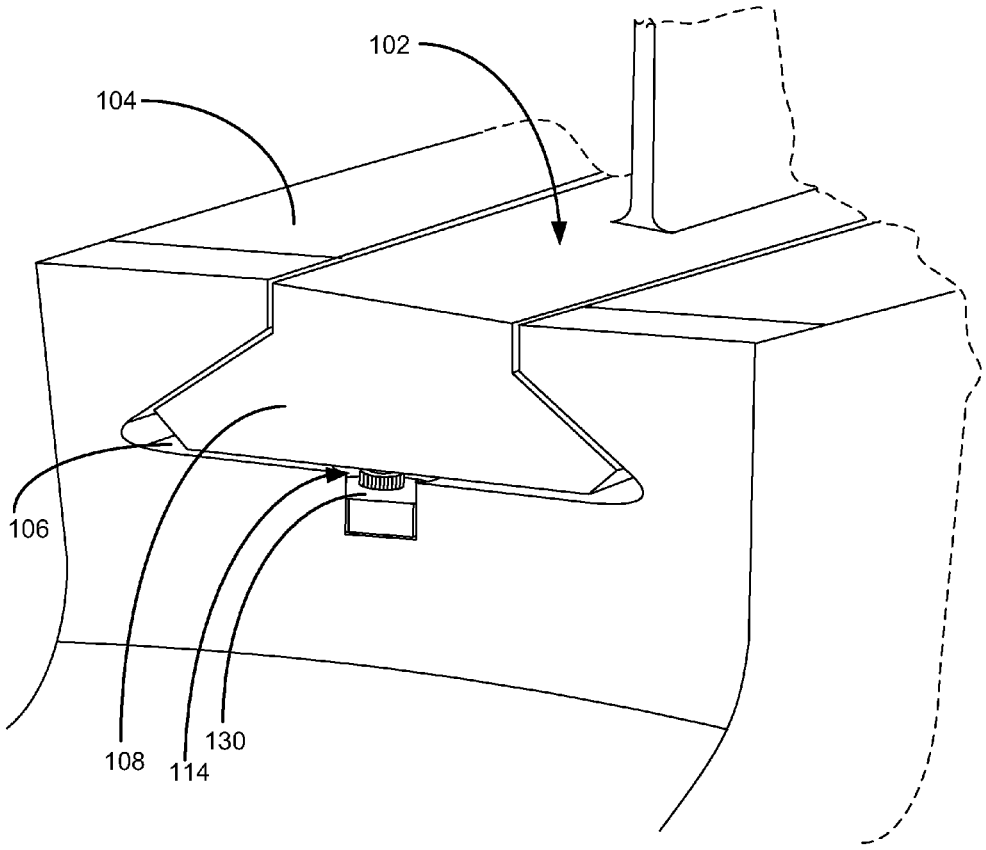
FIG. 3 is a perspective view of an embodiment of a rotor blade assembly including the rotor blade of FIG. 1A and staking insert of FIG. 2 positioned within the rotor of FIG. 1B.

In certain embodiments, one or more surfaces of the staking insert may be textured. For example, the projection 134 may be ribbed, as shown in FIGS. 1C, 2, and 3. In some embodiments, one or more sidewalls of the second staking recess are textured in a complementary pattern to the projection of the staking insert. In some embodiments, one or more sidewalls of the first staking recess are textured in a complementary pattern to the base portion of the staking insert.

As illustrated in FIG. 1C, The base portion 132 of the staking insert 130 may have a thickness 133 (the "base thickness") between 5 mm and 200 mm or, more specifically, between 5 mm and 75 mm or, even more specifically, between 5 mm and 35 mm. The projection 134 of the staking insert 130 may have a thickness 135 (the "projection thickness") between 5 mm and 200 mm or, more specifically, between 5 mm and 75 mm or, even more specifically, between 5 mm and 35 mm. In certain embodiments, the base thickness 133 and the projection thickness 135 are substantially equal. For example, the base thickness and the projection thickness may both be about 15 mm, giving the staking insert an overall thickness of about 30 mm.

FIG. 2 shows a staking insert 130 being positioned within the axial slot 106 of the rotor 104 illustrated in FIG. 1B. In certain embodiments, the first staking recess 114 is sized and shaped to receive the base portion 132 of the staking insert 130. For example, the first staking recess 114 may have a complementary shape to the base portion 132 of the staking insert 130. Where the base portion 132 of the staking insert 130 has a flat sidewall 138 with a convex sidewall 136 extending therefrom, the flat sidewall 138 may be positioned in the axial opening 120 of the first staking recess 114. In some embodiments, the first staking recess has a depth (the "first depth") that is at least about the sum of the base thickness and the projection thickness of the staking insert. For example, where both the base and projection thickness are about 15 mm each, the first depth may be at least about 30 mm. In certain embodiments, the first depth of the first staking recess is between 10 mm and 400 mm or, more specifically, between 10 mm and 250 mm or, even more specifically, between 10 mm and 100 mm.

The first staking recess 114 may function to retain the base portion 132 of the staking insert 130 within the rotor 104. In certain embodiments, the first staking recess 114 axially secures the staking insert 130 therein during operation. As used herein, the term "axially" refers to a direction of movement parallel to the length of the axial slot.

In certain embodiments, the second staking recess is sized and shaped to receive the projection of the staking insert. The second staking recess may have a complementary shape to the projection of the staking insert. For example, where the projection of the staking insert has a substantially cylindrical shape, the second staking recess may comprise a substantially cylindrical shape with a larger diameter than that of the projection. In some embodiments, the second staking recess has a depth (the "second depth") that is substantially equal to the projection thickness of the staking insert. For example, where the projection thickness is about 15 mm, the second depth may be about 15 mm.

The projection of the staking insert 130 functions to secure the blade 102 within the axial slot 106 in both the forward and aft directions during operation. As used herein, the terms "forward direction" and "aft direction" refer to directions of movement parallel to the length of the axial slot.

FIG. 3 shows a staking insert 130 positioned within the first staking recess 114 of the axial slot 106 of the rotor 104 illustrated in FIGS. 1 and 2. The root 108 of the blade 102 is positioned within the axial slot 106 of the rotor 104 such that the base of the root 108 of the blade 102 faces the first staking recess 114. In certain embodiments, the second staking recess disposed on the base of the root 108 of the rotor blade 102 faces the first staking recess 114. The blade 102 may function to retain the staking insert 130 within the rotor 104. In certain embodiments, the blade 102 radially secures the staking insert 130 within the first staking recess 114 during operation. As used herein, the term "radially" refers to a direction of movement in a plane transverse to a plane containing the axial slot.

Figure 4:
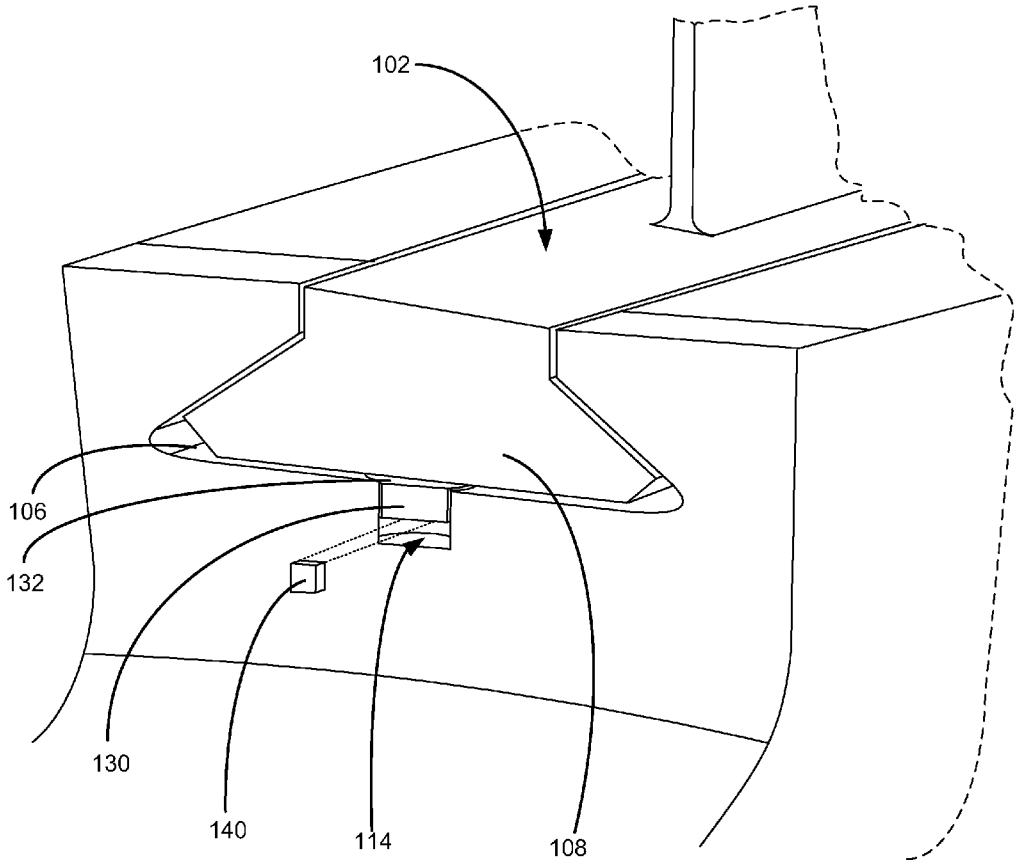
FIG. 4 is a perspective view of a shim being positioned within the rotor assembly of FIG. 3.

FIG. 4 shows a shim 140 positioned to be inserted into the first staking recess 114 in which the base portion 132 of the staking insert 130 is already disposed. The root 108 of the rotor blade 102 is disposed in the axial slot 106 such that the projection of the staking insert 130 is disposed within the second staking recess of the blade 102.

In one embodiment, the shim has a thickness (the "shim thickness") that is at least substantially equal to the second depth of the second staking recess of the blade. For example, where the second depth is about 15 mm, the shim thickness may also be about 15 mm. In certain embodiments, the shim thickness is between 5 mm and 200 mm or, more specifically, between 5 mm and 75 mm or, even more specifically, between 5 mm and 35 mm. The shim 240 may function to secure the staking insert within the first and second staking recesses during operation.

Figure 5:
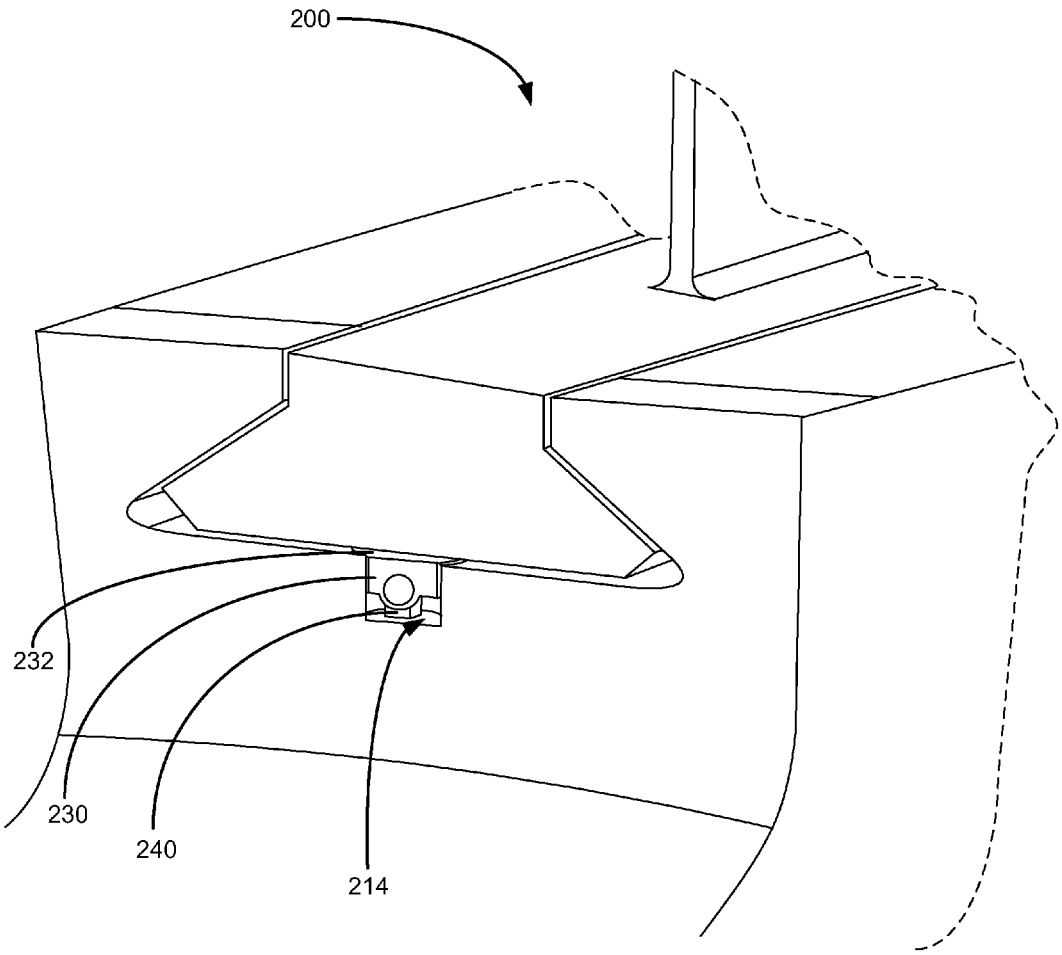
FIG. 5 is a perspective view of the completed rotor assembly of FIG. 4.

FIG. 5 shows the completed rotor assembly 200 of FIG. 4 in which the shim 240 is positioned within the first staking recess 214, adjacent to the base portion 232, and opposite the projection, of the staking insert 230.

In certain embodiments, the staking insert 230 is deformed to retain the shim 240 within the first staking recess 214, as shown in FIG. 5. For example, the staking insert may be deformed mechanically with a nail punch or similar tool.

The staking insert and shim may be constructed from such materials as are known in the art and are suitable for use in turbines and turbine-like conditions. For example, the staking insert and shim may be constructed from a metal alloy such as steel alloy, nickel alloy, or another heat and corrosion resistant material.

In another aspect, a gas turbine is provided having the rotor assembly disposed therein. The rotor assembly may include at least one axial slot positioned about the rim of a rotor and a blade positioned within each axial slot. Each axial slot may have a first staking recess and each blade may have a second staking recess. A staking insert having a base portion and a projection may be positioned within each axial slot, the base portion being disposed in the first staking recess and the projection being disposed within the second staking recess. A shim may be positioned within each first staking recess, adjacent to the base portion, and opposite the projection, of the staking insert. Each staking insert may be deformed to retain the shim within the first staking recess. For example, a gas turbine may include a plurality of axial slots positioned about a rotor with a plurality of blades secured by a plurality of staking inserts and shims therein.

In a third aspect, a method for staking a blade in a rotor assembly is provided. The method includes (i) providing a rotor having at least one axial slot positioned about a rim of the rotor with each axial slot including a first staking recess positioned therein, (ii) providing a blade having a second recess positioned therein, (iii) inserting a staking insert having a base portion and a projection therefrom into the first staking recess, (iv) positioning the blade within the axial slot, (v) inserting a shim into the first staking recess such that the projection of the staking insert is positioned within the second staking recess of the blade and the shim is adjacent to the base portion, and opposite the projection, of the staking insert, and (vi) deforming the staking insert such that the shim is retained within the first staking recess.

In certain embodiments, the method for staking a blade in a rotor assembly also includes a step of removing an existing staking insert prior to the step of inserting the staking insert into the first staking recess. The step of removing the existing staking insert may include (a) removing an existing shim from the first staking recess, (b) removing the blade from the axial slot of the rotor, and (c) removing the existing staking insert from the first and second staking recesses. For example, removing the existing staking insert may include grinding down the deformed portion of the staking insert and pulling out the shim with a suitable tool, such as needle-nose pliers.

Although the use of embodiments of the rotor assembly has been described herein with the use of a rotor, the present invention also may be applicable to any other type of rotating assembly or turbomachine. For example, other potential applications include rotating buckets of gas turbines, rotating buckets/blades of steam turbines, or the retention of any device that is mechanically attached to a rotating wheel or disk with an axial slot or dovetail arrangement.

It should be apparent that the foregoing relates only to the preferred embodiments of the present application and that numerous changes and modifications may be made herein by one of ordinary skill in the art without departing from the general spirit and scope of the invention as defined by the following claims and equivalents thereof.

We claim:

1. A rotor assembly, comprising:

a rotor;

at least one axial slot positioned about a rim of the rotor, each axial slot comprising a first staking recess positioned therein;

a blade positioned within each of the axial slots, the blade comprising a second staking recess positioned therein;

a staking insert comprising a base portion and a projection extending therefrom, the base portion being disposed within the first staking recess and the projection being disposed within the second staking recess; and a shim positioned within the first staking recess and radially inward of the base portion, opposite the projection, of the staking insert.

2. The rotor assembly of claim 1, wherein the first staking recess is sized and shaped to receive the base portion of the staking insert.

3. The rotor assembly of claim 1, wherein the second staking recess is sized and shaped to receive the projection of the staking insert.

4. The rotor assembly of claim 1, wherein the staking insert is deformed to retain the shim within the first staking recess.

5. The rotor assembly of claim 1, wherein the first staking recess has a first depth that is at least about a sum of a base thickness of the base portion of the staking insert and a projection thickness of the projection of the staking insert.

6. The rotor assembly of claim 5, wherein the second staking recess has a second depth that is substantially equal to the projection thickness.

7. The rotor assembly of claim 6, wherein the shim has a shim thickness that is at least substantially equal to the second depth.

8. The rotor assembly of claim 1, wherein the at least one axial slot comprises a substantial dovetail-like shape and the blade comprises a complementary shape.

9. The rotor assembly of claim 1, wherein the first staking recess and the second staking recess comprise substantial cylinder-like shapes, the first staking recess having a diameter equal to or larger than a diameter of the second staking recess.

10. The rotor assembly of claim 1, wherein the first staking recess functions to retain the base portion of the staking insert therein during its operation.

11. The rotor assembly of claim 1, wherein the projection of the staking insert functions to retain the blade within the axial slot in both the forward and aft directions during its operation.

12. The rotor assembly of claim 1, wherein the shim functions to secure the staking insert within the first and second staking recesses during its operation.

13. A gas turbine having a rotor assembly disposed therein, the rotor assembly comprising:

a rotor;

at least one axial slot positioned about a rim of the rotor, each axial slot comprising a first staking recess positioned therein;

a blade positioned within each of the axial slots, the blade comprising a second staking recess positioned therein;

a staking insert comprising a base portion and a projection extending therefrom, the base portion being disposed within the first staking recess and the projection being disposed within the second staking recess; and a shim positioned within the first staking recess and radially inward of the base portion of the staking insert, opposite the projection of the staking insert.

14. A method for staking a blade in a rotor assembly, comprising:

providing a rotor comprising at least one axial slot positioned about a rim of the rotor, each axial slot comprising a first staking recess positioned therein;

providing a blade comprising a second staking recess positioned therein;

inserting a staking insert into the first staking recess, the staking insert comprising a base portion and a projection therefrom;

thereafter positioning the blade within the axial slot of the rotor;

inserting a shim into the first staking recess such that the projection of the staking insert is positioned within the second staking recess of the blade and the shim is radially inward of the base portion, opposite the projection, of the staking insert; and deforming the staking insert such that the shim is retained within the first staking recess.

15. The method of claim 14, further comprising a step of removing an existing staking insert prior to inserting the staking insert into the first staking recess, the step of removing the existing staking insert comprising:

removing an existing shim from the first staking recess;

removing the blade from the axial slot of the rotor; and removing an existing staking insert from the first and second staking recesses.

16. The method of claim 14, wherein the first staking recess functions to retain the base portion of the staking insert therein during its operation.

17. The method of claim 14, wherein the projection of the staking insert functions to retain the blade within the axial slot in both the forward and aft directions during its operation.

18. The method of claim 14, wherein the shim functions to secure the staking insert within the first and second staking recesses during its operation.

19. The method of claim 14, wherein:

the first staking recess has a first depth that is at least about a sum of a base thickness of the base portion of the staking insert and a projection thickness of the projection of the staking insert, the second staking recess has a second depth that is substantially equal to the projection thickness, and the shim has a shim thickness that is at least substantially equal to the second depth.

20. The method of claim 14, wherein the first staking recess and the second staking recess comprise substantial cylinder-like shapes, the first staking recess having a diameter larger than a diameter of the second staking recess.

* * * * *